US008556166B1

(12) United States Patent
Folk et al.

(10) Patent No.: US 8,556,166 B1
(45) Date of Patent: Oct. 15, 2013

(54) CORRELATION OF INFORMATION TO A TRANSACTION IN A CASH HANDLING DEVICE

(75) Inventors: Amy Baker Folk, Charlotte, NC (US); Daniel Christopher Bohen, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 303 days.

(21) Appl. No.: 12/183,895

(22) Filed: Jul. 31, 2008

(51) Int. Cl.
*G07F 19/00* (2006.01)

(52) U.S. Cl.
USPC ..... 235/379

(58) Field of Classification Search
USPC ..... 235/375, 379, 380, 383; 705/1.1, 39, 705/43; 382/135
See application file for complete search history.

(56) References Cited

U.S. PATENT DOCUMENTS

| | | | | |
|---|---|---|---|---|
| 5,120,945 | A * | 6/1992 | Nishibe et al. | 235/379 |
| 5,426,281 | A | 6/1995 | Abecassis | |
| 6,023,688 | A | 2/2000 | Ramachandran et al. | |
| 6,045,039 | A | 4/2000 | Stinson et al. | |
| 6,149,055 | A | 11/2000 | Gatto | |
| 7,066,384 | B2 * | 6/2006 | Yokoi et al. | 235/379 |
| 8,162,125 | B1 * | 4/2012 | Csulits et al. | 194/206 |
| 2001/0018739 | A1 * | 8/2001 | Anderson et al. | 713/176 |
| 2003/0202690 | A1 * | 10/2003 | Jones et al. | 382/139 |
| 2004/0010466 | A1 * | 1/2004 | Anderson | 705/45 |
| 2005/0040225 | A1 * | 2/2005 | Csulits et al. | 235/379 |
| 2005/0108165 | A1 * | 5/2005 | Jones et al. | 705/43 |
| 2006/0010071 | A1 * | 1/2006 | Jones et al. | 705/42 |
| 2006/0157390 | A1 * | 7/2006 | Otsuka | 209/534 |
| 2007/0122023 | A1 * | 5/2007 | Jenrick et al. | 382/135 |
| 2007/0125839 | A1 * | 6/2007 | Royce-Winston | 235/379 |
| 2007/0174185 | A1 * | 7/2007 | McGoveran | 705/39 |
| 2008/0219543 | A1 * | 9/2008 | Csulits et al. | 382/135 |
| 2009/0236200 | A1 * | 9/2009 | Hallowell et al. | 194/215 |

* cited by examiner

*Primary Examiner* — Daniel Hess
*Assistant Examiner* — Steven J Malone
(74) *Attorney, Agent, or Firm* — Banner & Witcoff, Ltd.; Michael A. Springs

(57) ABSTRACT

Methods and devices provide correlation of information to a transaction in cash handling devices. A first input may be provided to a cash handling device in order to initiate a transaction. Information related to the transaction to be entered in the cash handling device. The information may be correlated to the transaction in the cash handling device. The information may be stored in the cash handling device.

22 Claims, 7 Drawing Sheets

CORRELATION OF INFORMATION TO A TRANSACTION IN A CASH HANDLING DEVICE

BACKGROUND

In cash handling devices (e.g., cash recyclers), some transactions may result in problems or errors for which the cash handling devices do not have a predefined solution or predefined way of indicating the issue.

For example, assume that a cash handling device is only able to scan (and thus automatically recognize) paper currency. Further assume that the cash handling device will allow coins to be deposited into it, but that the cash handling device cannot count automatically or otherwise recognize the deposited coins. In addition, the cash handling device may also be able to scan checks or non-currency paper items.

In this situation, consider a transaction in which $250, for example, is deposited and $200 of the deposit is in the form of paper currency and the remaining $50 balance is in the form of coins. The person making the deposit may indicate to the cash handling device that the amount of the deposit is $250. However, the cash handling device will only be able to recognize automatically $200 of the deposit and will not be able to recognize the remaining $50 of coins. Consequently, there will be a logical and physical mismatch between the amount of money that the cash handling device has recognized and the amount of money that is actually contained therein. Additionally, the cash handling device might not know the cause of the mismatch due to a lack of information.

The same types of problems may be encountered with other cash handling transactions (e.g., rebalances, withdrawals, and the like)

SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

In accordance with various embodiments of the present invention, methods and devices can provide correlation of notes, memoranda or other information to a transaction in a cash handling device. In particular, information may be entered or specified by a user if a predefined notation or indication for the issue is not defined in the cash handling device. Using such a system, a cash handling device and a business or other customer may be able to compensate for issues based on the additional information.

In one embodiment, a transaction may be initiated on a cash handling device. Information related to the transaction may be entered in the cash handling device. The information may be correlated to the transaction. The information may be stored in the cash handling device.

In another embodiment, information correlated to the transaction may be stored as metadata.

In still another embodiment, information correlated to the transaction may be stored as a file in memory on the cash handling device.

In further embodiments, information may be correlated to the transaction by virtue of a link, a pointer, a uniform resource locator, or other identifier.

In various embodiments, information correlated to the transaction may be stored in a variety of formats including, but not limited to, metadata, a database record, a text file, a rich text file, an html file, an audio file, and an image file.

In another embodiment, a transaction to deposit currency into a cash handling device may be initiated. The currency may include one or more one paper bills and one or more coins. A user may identify the total amount of currency that is deposited or to be deposited into the cash handling device. The paper bills may be scanned by the cash handling device. Information about the deposit transaction may be entered into the cash handling device. The information may be stored in memory in the cash handling device. The information may be correlated with the deposit transaction in the cash handling device. The information may also be sent to client systems that would allow the client user to avoid having to manual enter information in their systems.

In addition, the foregoing embodiments can be implemented in an apparatus that includes a processor for executing computer executable instructions, memory that stores the computer executable instructions, an input means for receiving user input, a display for displaying information to the user and, optionally, to receive input from a user. Each of the above-identified method steps can be implemented as computer-executable instructions that are stored in the memory and executed by the processor.

In still another embodiment, the cash handling device may be a cash recycler.

In another embodiment, an input means and display may include a touch sensitive screen.

In yet another embodiment, the input means may include a touch-sensitive screen, digitizer, voice input, or data feed.

In still another embodiment, the display may include a touch sensitive screen.

In other embodiments, the input means may include a keypad or keyboard.

Additional features and advantages of the invention will be apparent upon reviewing the following detailed description.

BRIEF DESCRIPTION OF THE DRAWINGS

The present disclosure is illustrated by way of example and not limited in the accompanying figures in which like reference numerals indicate similar elements.

DETAILED DESCRIPTION

In accordance with various aspects of the disclosure, systems and methods are illustrated for providing correlation of information and a transaction in a cash handling devices.

Aspects of the present disclosure relate to cash handling devices. Cash handling devices generally refer to devices that are configured to accept and/or dispense currency. In addition, the cash handling device may also be able to scan checks or non-currency paper items. Cash handling devices include payment kiosks, point of sale systems such as cash registers, automated teller machines (ATMs), currency recyclers and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
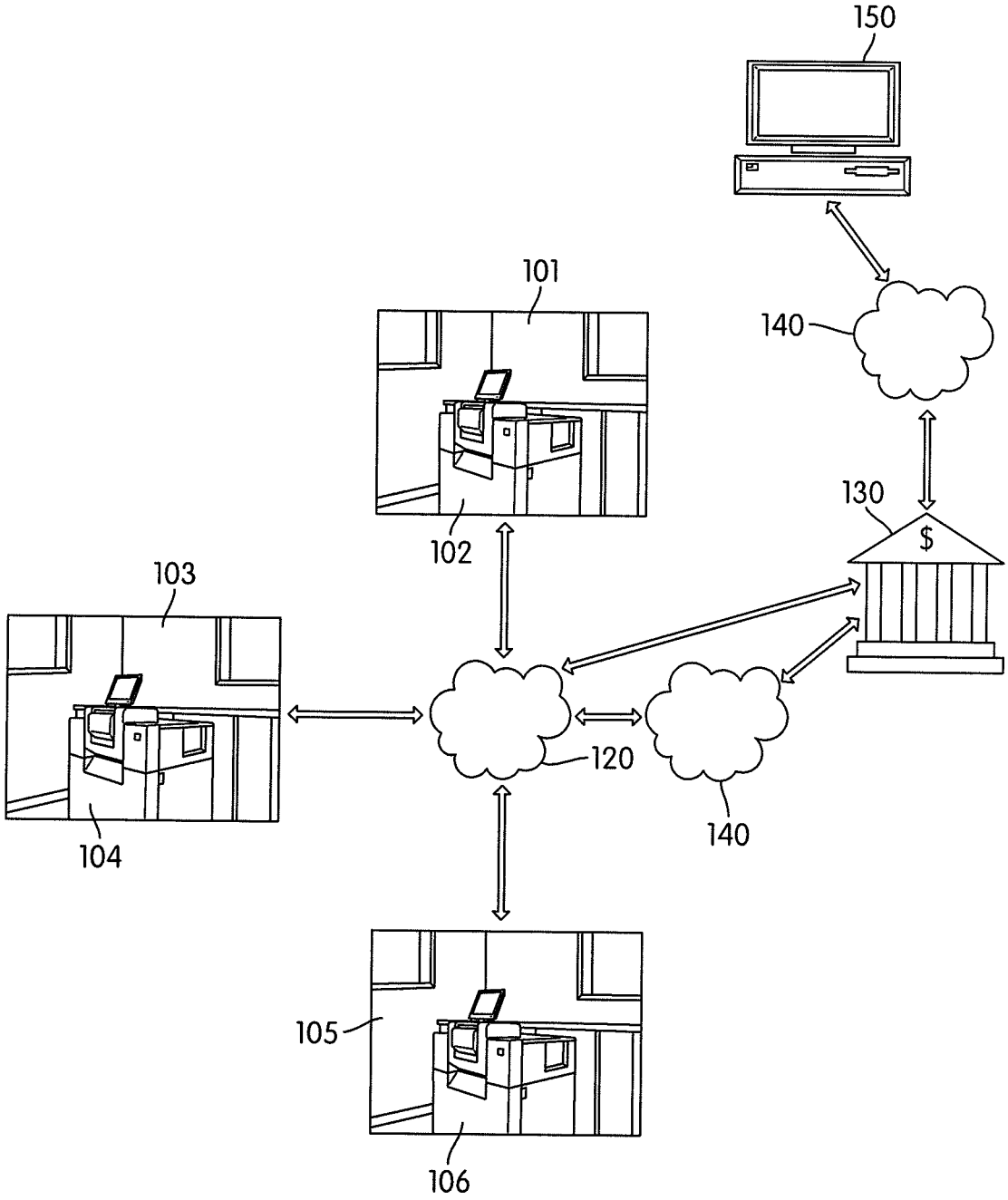
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 before being connected to bank 130. According to one or more arrangements, bank 130 may utilize an infrastructure which includes a server 150 having components such as a memory, a processor, a display, and a communication interface.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, stackers 217 and cartridges 215 are configured to store currency. Currency may be inserted through input slot 209 and withdrawn through withdrawal slot 211. Stackers 217 may be used to store and organize currency based on denomination. For example, all $5 bills may be stored in stacker 2 (i.e., stacker 217B) while all $20 bills may be stored in stacker 3 (i.e., stacker 217C). Cartridges 215A and 215B, on the other hand, may be used to store overflow currency and/or currency for transport. Thus, if stackers 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and stackers 217 may further be removable for easier access or transport.

Scanning unit 207 may be configured to scan each bill or currency that is inserted into recycler 200. Scanning unit 207 may be configured to detect defects, deceptive reproductions of currency, denomination, type of currency (e.g., which country the currency originates from) and the like. Scanning unit 207 may further be configured to refuse money (either through input slot 209 or withdrawal slot 211) if it cannot be properly recognized or if the currency is deemed to be a reproduction with deceptive intent. Scanning unit 207 may send such data to processor 201 which may, in turn, save the data in memory 203.

Further, recycler 200 may include one or more mechanical or electromechanical systems (not shown) for automatically transferring currency between stackers 217, cartridges 215, input slot 209 and withdrawal slot 211 in recycler 200. For example, currency may automatically be withdrawn from stackers 217 and directed into cartridge 215A for storage using a series of motorized rollers. In another example, currency stored in cartridge 215A may be withdrawn and organized and stored into stackers 217 according to denomination. Using such systems to facilitate the automated movement of currency between storage components and other portions of recycler 200 may provide efficiency and security by alleviating some of the need to manually handle currency stored within recycler 200.

Figure 2:
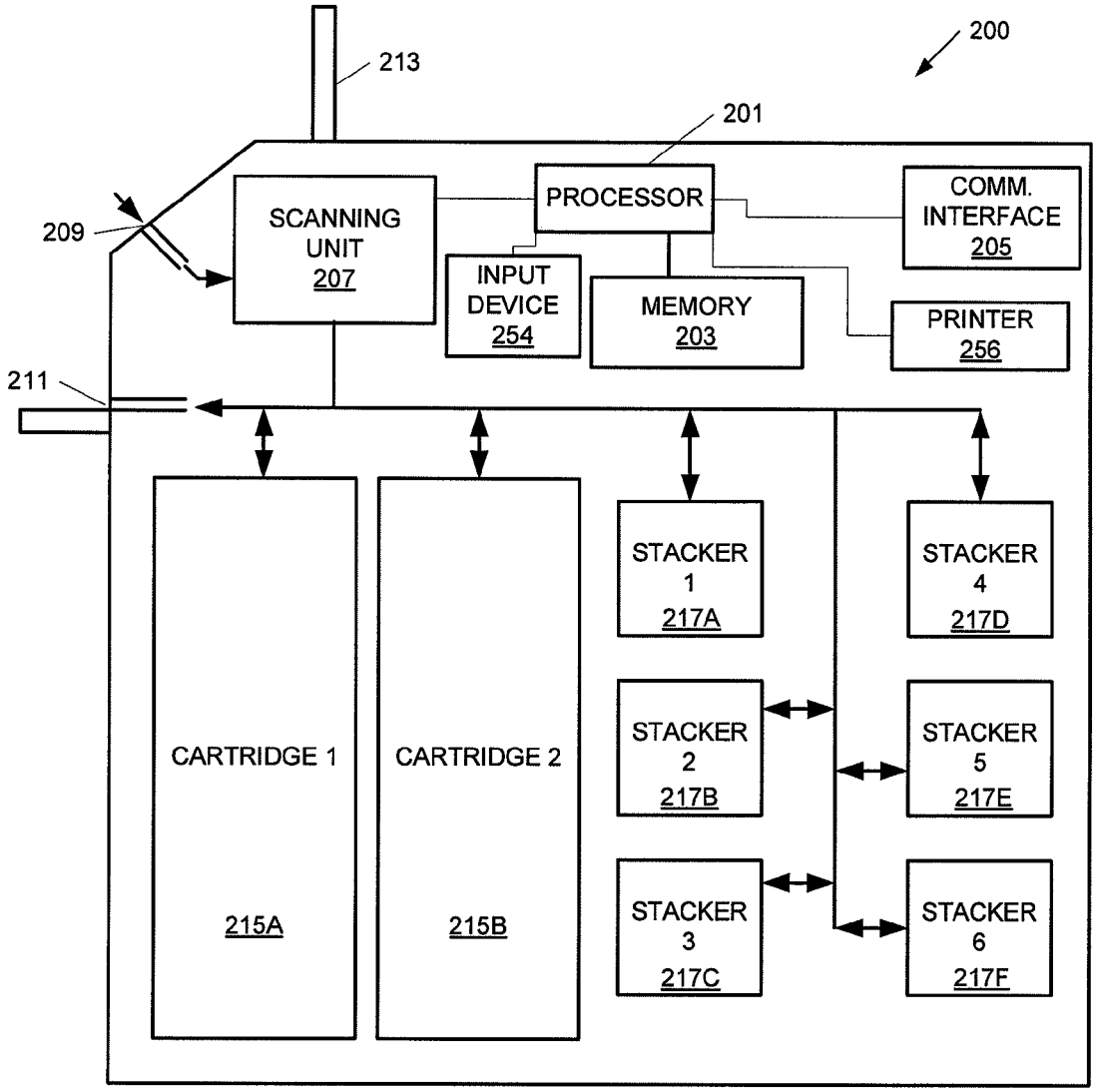
FIG. 2 illustrates a simplified diagram of a cash handling device in accordance with an aspect of the invention.
Figure 3:
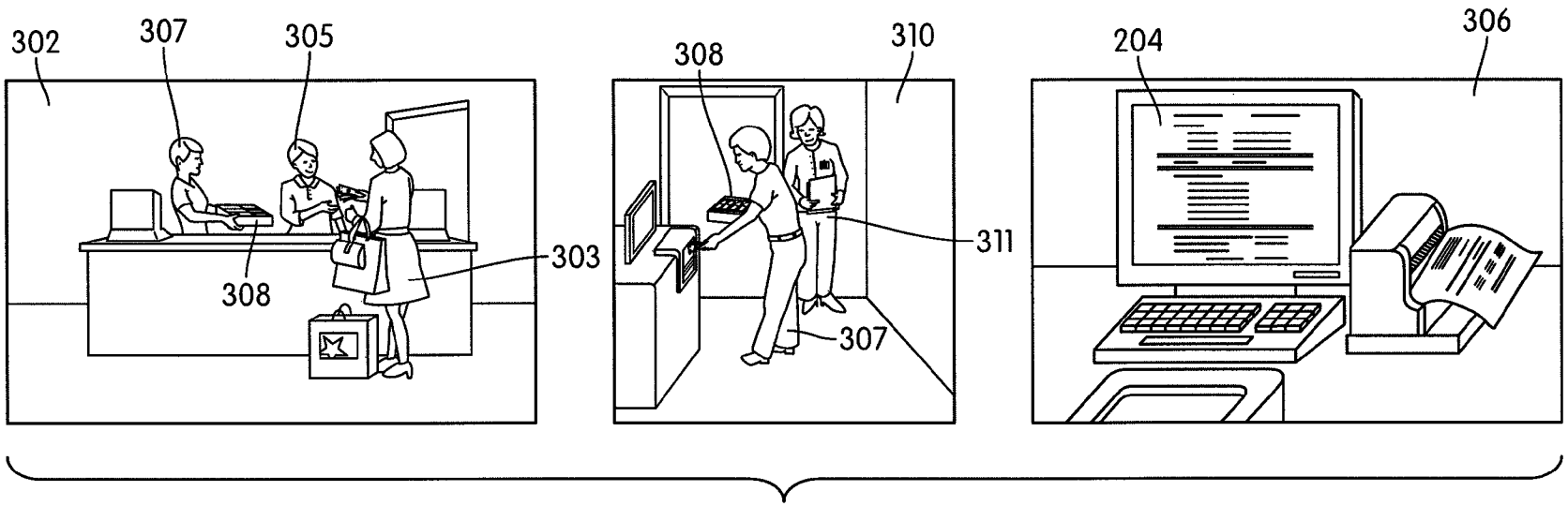
FIG. 3 illustrates various features of a cash handling device that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
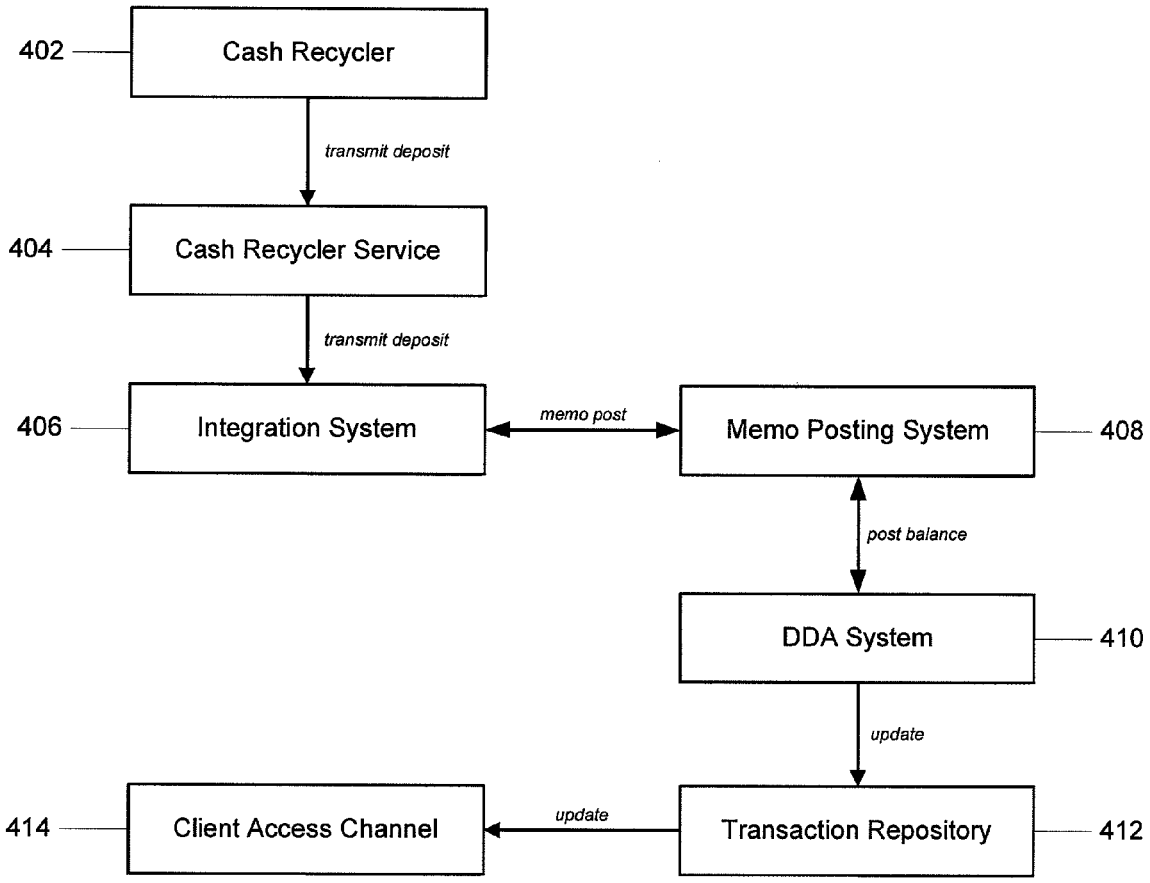
FIG. 4 illustrates a system configuration that may be used in accordance with an aspect of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

Figure 5:
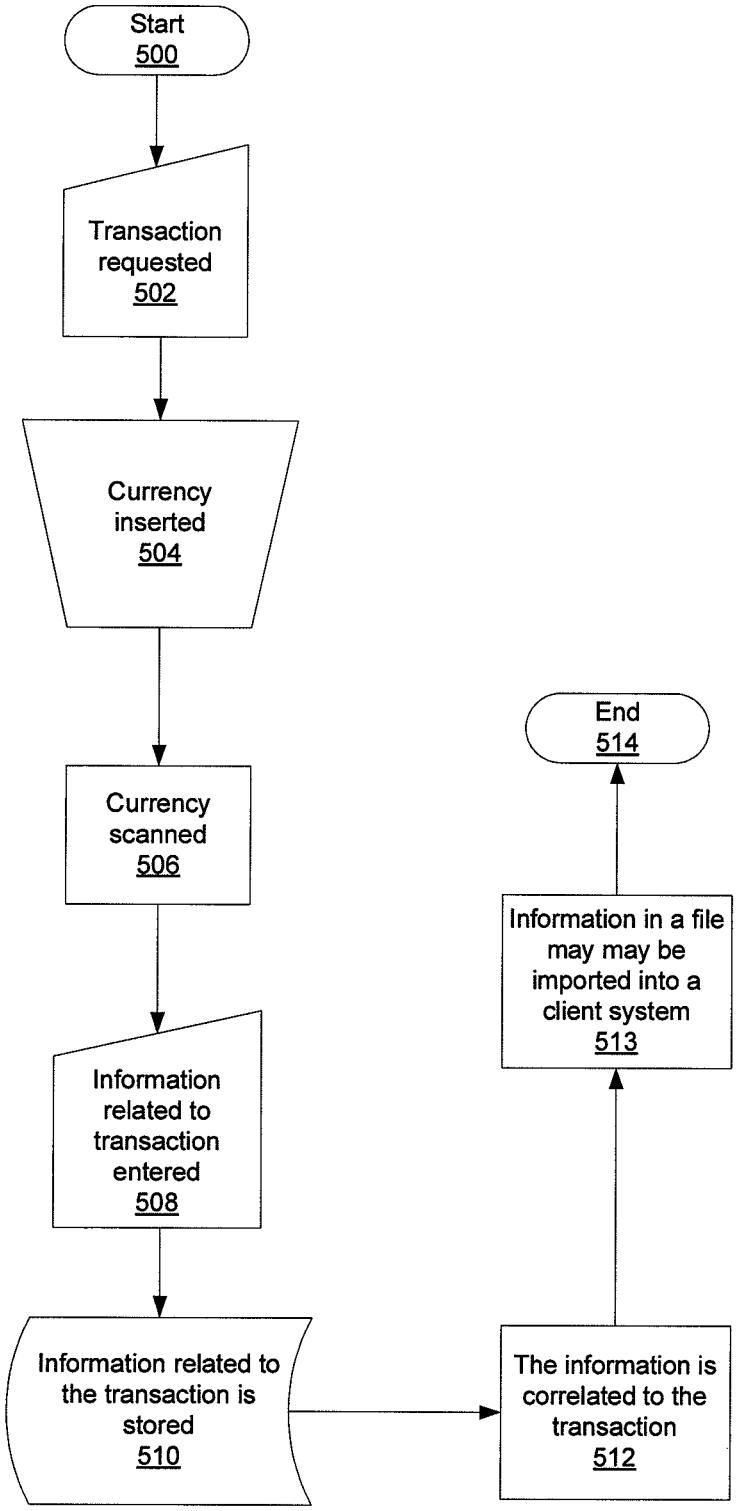
FIG. 5 illustrates an example method of correlating information and a transaction in a cash handling device.

FIG. 5 illustrates an example method of correlating information and a transaction in a cash handling device. Upon start 500, a user may request a transaction 502. Any type of transaction may be requested including, but not limited to, a deposit, a withdrawal, a rebalance, and the like For example, in the case of a deposit transaction, currency may be inserted 504. The currency may include paper bills as well as coins. In addition, the cash handling device may also be able to scan checks or non-currency paper items. The cash handing device 200 may use scanning unit 207 to scan any paper bills included within the inserted currency 506. Information related to the transaction (e.g., the deposit transaction in this example) may be entered by the user 508. This information may be any type of information that is related to the transaction. For example, the information may identify the amount of coins that were deposited into the cash handling device. Thus, this information taken in conjunction with the information determined as a result of the scanning of the paper bills will enable a logical and physical matching of the currency that was deposited into the cash handling device. In some instances, the information may include user specified notes about one or more aspects of the particular transaction. In one example, a user may enter a note stating "Multiple bills are severely torn," to note that damage to the bills may cause discrepancies in a balance count or during processing downstream.

The information related to the transaction may be stored 510 in memory 203 in the cash handling device 200. The information may also be correlated to, connected with, made part of, and the like the transaction 512. A person of skill in the art will understand that this may be accomplished in a variety of ways. For example, the information may be stored as metadata (also known as metainformation) and thus correlated with the transaction. The information may also be stored as a separate file. Any type of file may be used. If stored as a separate file, a link, uniform resource locator, pointer, database record, or other identifier may correlate one with the other. If a separate file is desired, any type of file format may be used such as, for example, a text file, a rich text file, an html file, an audio file, an image file, and the like. Additionally or alternatively, when storing the information in association with the transaction, additional data may be automatically added to the information such as a date and time of entry, a user ID or name, a location and the like. This additional information may be help in conducting audits or resolving issues that may arise.

Any type of input device may be used to provide the information that is to be correlated to the transaction 512. Sample input devices include: a keypad, a keyboard, a mouse, a touch-sensitive screen, a digitizer, a microphone, a voice feed, a data feed from another device, and the like. After the information related to the transaction has been entered 508, correlated 510, and stored 512, the process may end 514.

Figure 6:
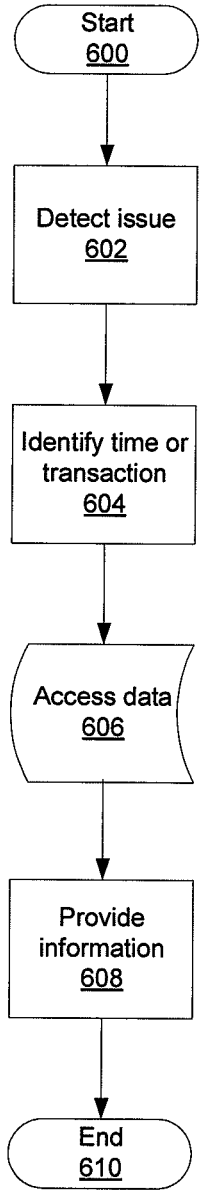
FIG. 6 illustrates an example method of using data after it has been stored in the cash handling device.

FIG. 6 illustrates a sample method of using data after it has been stored 510 in memory 203 in the cash handling device 200. For example, one use of the data might be to detect discrepancies and extract memo data or other information for audits or resolving discrepancies.

After initiation 600 of an appropriate process in this example, an issue may be detected 602 or a request may be made by a user. A sample issue that might be detected could be a discrepancy between the logical and physical balance of currency in the cash handling device. This could happen, for example, if the amount of money entered by a retail store or user does not match the physical count in the cash handling device 200. Of course, many other issues could be detected as well.

After detection of an issue 602 or upon user request, the time period could be identified 604 during which the information related to the transaction was entered 508. Alternatively, the transaction number could be located or entered 604. This may then be used to identify the information that was correlated to the transaction 512 and then to access the information 606 in or extract it from memory 203.

The information may then be provided to the user 608 for appropriate audit, reconciliation, information gathering, or other functions. The information may also be provided in order to facilitate either manual or automatic resolution of any discrepancies. As an example, if the information was a memo, it could be automatically transmitted to the financial institution server 150 so that the bank would understand the reason for the discrepancy. In addition, the information could also be sent to client systems that would allow the client user to avoid having to key in the information in their systems.

Figure 7:
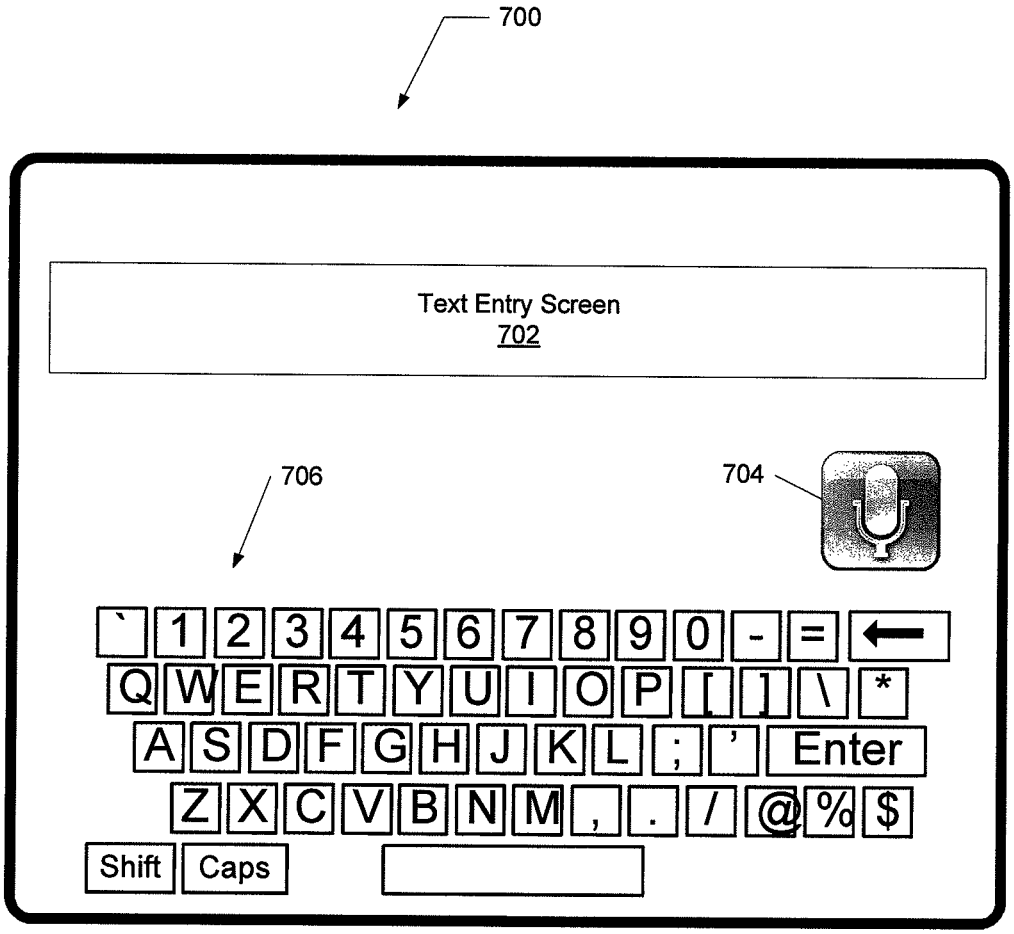
FIG. 7 depicts a sample graphical user interface for an information entry screen.

FIG. 7 depicts a sample graphical user interface for an information entry screen 700. For example, a virtual keyboard 706 may be used to enter text into a text entry screen or window 702. Of course, a physical keyboard could be used too. Alternatively, a microphone or other control buttons could be used to record and enter a voice message as the information relating to the transaction.

Although the above embodiment has been described in the context of a deposit transaction example, different embodiments of the present invention may be used in any other type of transaction (e.g., rebalancing, withdrawal, and the like. In short, a transaction may be requested and initiated on a cash handling device 502. Information related to the transaction may be entered in the cash handling device 508. The information may be correlated to the transaction 512. And, the information may be stored 510. Further, the information could also be sent to client systems that would allow the client user to avoid having to key in the information in their systems 513. These flexible steps allow various aspects of the present invention to be used with any type of transaction.

Although not required, one of ordinary skill in the art will appreciate that various aspects described herein may be embodied as a method, a data processing system, or as one or more computer-readable media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

We claim:

1. A method comprising:

enabling initiation of a deposit transaction on a cash handling device;

receiving, by a computer system, transaction information related to the transaction to be entered in the cash handling device;

correlating, by the computer system, the transaction information to the transaction, wherein the transaction information includes additional information that is entered and specified when an indication of an issue is not defined in the cash handling device wherein the additional information is inputted by a user during the transaction describing a damaged condition of currency deposited into the cash handling device during the transaction and wherein the issue included in the transaction information is not specifically prompted by the cash handling device;

storing, by the computer system, the transaction information in the cash handling device;

compensating the transaction based on the additional information; and detecting discrepancies and extracting the additional information for audits or resolving the discrepancies.

2. The method of claim 1 wherein the transaction information is stored as metadata for the transaction.

3. The method of claim 2 wherein the correlation is selected from the group consisting of: a link, a uniform resource locator, a database record, and a pointer.

4. The method of claim 2 wherein the transaction information is stored in a format selected from the group consisting of: text, rich text, html, audio file, and image file.

5. The method of claim 4 wherein the transaction information is input by a device selected from the group consisting of: a keypad, a keyboard, a mouse, a touchscreen, a digitizer, and a microphone.

6. The method of claim 2 wherein the cash handling device comprises a cash recycler.

7. The method of claim 6 wherein the steps of the method are implemented as computer-executable instructions stored on a computer-readable medium.

8. The method of claim 1 wherein the transaction information is stored as a file in memory on the cash handling device.

9. The method of claim 8 wherein the cash handling device comprises a cash recycler.

10. The method of claim 9 wherein the steps of the method are implemented as computer-executable instructions stored on a computer-readable medium.

11. The method of claim 1, wherein the additional information includes a physical characteristic of currency deposited into the cash handling device during the transaction.

12. The method of claim 1, wherein the transaction information comprises a memorandum provided by a user during the transaction.

13. A method comprising:

enabling a user to initiate a transaction to deposit currency into a cash handling device, said currency including at least one paper bill and at least one coin;

receiving from the user a manual identification of a total amount of the currency deposited wherein the identification is via an input device selected from the group consisting of: a keypad, a keyboard, a mouse, a touchscreen, a digitizer, or a microphone;

scanning, by a computer system, said at least one paper bill by the cash handling device;

receiving, by the computer system, transaction information about the transaction to be entered into the cash handling device;

storing, by the computer system, said transaction information in memory in the cash handling device;

correlating, by the computer system, the transaction information and the transaction together in the cash handling device, wherein the transaction information includes additional information that is entered and specified when an indication of an issue is not defined in the cash handling device wherein the additional information is inputted by the user during the transaction describing a damaged condition of currency deposited into the cash handling device during the transaction and wherein the issue included in the transaction information is not specifically prompted by the cash handling device; and compensating the transaction amount based on the additional information.

14. The method of claim 13 wherein the transaction information identifies an amount difference between said at least one paper bill that was scanned and the manual identification of the total amount of currency deposited.

15. The method of claim 14 wherein the transaction information is stored as metadata for the transaction.

16. The method of claim 14 wherein the transaction information is stored as a file in memory on the cash handling device and is correlated to the transaction by a link.

17. The method of claim 14 wherein the transaction information is stored in a format selected from the group consisting of: text, rich text, html, audio file, and image file.

18. An apparatus comprising:

a processor for executing computer-executable instructions;

memory that stores the computer-executable instructions;

a scanner to scan at least one paper bill;

a display;

an input means for receiving user input;

wherein the computer executable instructions cause the apparatus to:

receive a first input through the input means in order to request a deposit transaction;

enable currency to be inserted into the apparatus, said currency including said at least one paper bill and at least one coin;

use the scanner to scan said at least one paper bill;

receive a second input through the input means to indicate a total amount of the currency inserted into the apparatus;

receive a third input through the input means to provide transaction information about the deposit transaction;

store the transaction information in the memory;

correlate in memory the transaction information with the deposit transaction, wherein the transaction information includes additional information that is entered and specified by a user during the deposit transaction describing a damaged condition of the currency inserted into the apparatus;

compensate the transaction based on the additional information; and detect discrepancies and extract the additional information for audits or resolving the discrepancies.

19. The apparatus of claim 18 wherein the processor, the memory, the scanner, the display, and the input means are included within a cash handling device.

20. The apparatus of claim 19 wherein the processor, the memory, the display, and the input means are included within a cash recycler.

21. The apparatus of claim 20 wherein the transaction information is stored in said memory in a format selected from the group consisting of: metadata, a database record, a text file, a rich text file, an html file, an audio file, and an image file.

22. The apparatus of claim 21 wherein the correlation in memory is selected from the group consisting of: a link, a uniform resource locator, a database record, and a pointer.

* * * * *